US005195646A

United States Patent [19]

Robinson

[11] Patent Number: 5,195,646

[45] Date of Patent: Mar. 23, 1993

[54] RADIATOR CAP COVER

[76] Inventor: Ricky L. Robinson, 6546 Hollywood Blvd., Suite 201, Hollywood, Calif. 90028

[21] Appl. No.: 893,825

[22] Filed: Jun. 4, 1992

[51] Int. Cl.[5] ..... B65D 51/18

[52] U.S. Cl. ..... 220/256; 220/731; 220/DIG. 19; 220/DIG. 32

[58] Field of Search ..... 220/200, 255, 256, 306, 220/376, 731, 890, DIG. 9, DIG. 19, DIG. 21, DIG. 32, DIG. 33; 81/3.08, 3.09, 3.15, 3.35, 176.15, 176.2; 215/303

[56] References Cited

U.S. PATENT DOCUMENTS

| | | | |
|---|---|---|---|
| 1,923,336 | 8/1933 | Stant | 220/DIG. 32 X |
| 2,528,372 | 10/1950 | Kellogg | 220/201 |
| 2,661,859 | 12/1953 | Dolezal | 220/DIG. 32 X |
| 3,014,389 | 12/1961 | O'Hara | 81/176.2 |
| 3,048,067 | 8/1962 | Miles et al. | 81/3.08 |
| 3,121,355 | 2/1964 | Morel et al. | 81/176.2 |
| 3,186,263 | 6/1965 | Grote | 81/3.08 |
| 3,695,480 | 10/1972 | Castiglia | 220/376 |
| 4,697,480 | 10/1987 | Robideau | 81/3.09 |
| 5,011,040 | 4/1991 | Kinast | 220/375 |

FOREIGN PATENT DOCUMENTS

| | | | |
|---|---|---|---|
| 2193195 | 2/1988 | United Kingdom | 220/DIG. 32 |

*Primary Examiner*—Allan N. Shoap
*Assistant Examiner*—Nova Stucker
*Attorney, Agent, or Firm*—Richard C. Litman

[57] ABSTRACT

A radiator cap cover that engages a radiator cap to deflect steaming radiator coolant downward and away from a user during overheating of a radiator and unscrewing of the radiator cap is disclosed. Gripping structure conforming to the fingers of a user's hand is provided on the top of the radiator cap cover to aid in unscrewing the radiator cap. Flexible tabs along the interior wall of the radiator cap cover engage the radiator cap.

6 Claims, 2 Drawing Sheets

FIG. 3
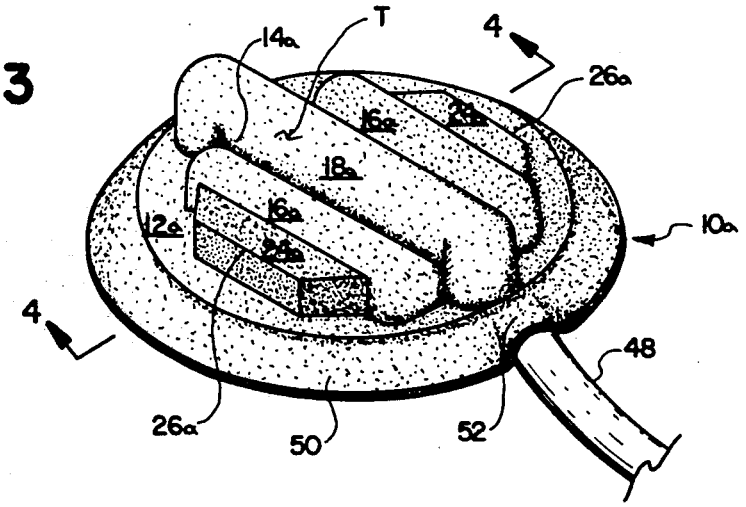
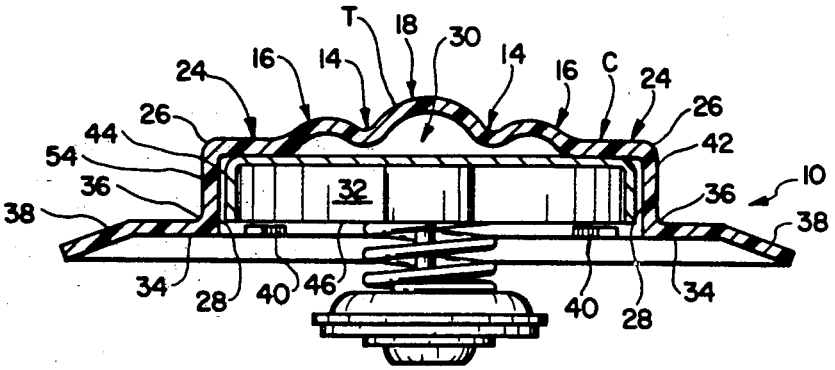
FIG. 2
FIG. 1
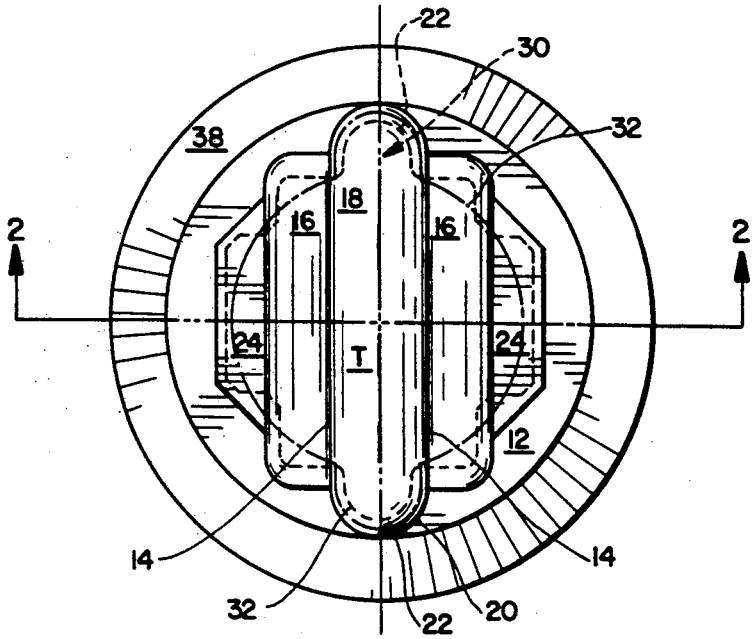

RADIATOR CAP COVER

BACKGROUND OF THE INVENTION

1. Field of the Invention

The present invention relates to the field of automotive safety, and more specifically, to a new and improved permanent radiator cap cover that safely deflects hot fluids downward away from the human body at such times as it may be necessary to remove the radiator cap. Many people have been seriously injured when removing the radiator cap from an overheated automotive radiator. Often when driving in hot weather in the mountains, car radiators will become overheated. During these unfortunate times, one must wait for the radiator to cool down before attempting to add coolant. Because of various distractions, one can forgetfully proceed to unscrew the radiator cap while the radiator is still overheated. The consequence is an unexpected and dangerous emanation of hot radiator fluid and steam that can scald the skin and stain clothing. This dangerous and annoying situation can be prevented by the unique radiator cap cover of this invention.

2. Description of the Prior Art

U.S. Pat. No. 3,014,389 issued to Raymond F. O'Hara on Jan. 27, 1959, discloses a radiator cap remover with a deflector. The cap remover is a wrench that grips the cap. The cap is removed by turning a handle. A deflector is provided to protect a user from possible scalding by emerging steam.

U.S. Pat. No. 3,048,067 issued to Leroy E. Miles et al. on Feb. 14, 1961, discloses a radiator cap tool with a shield. The tool is essentially a socket that has magnets to grip and hold a radiator cap as it is lifted away.

U.S. Pat. No. 3,121,355 issued to Emery B. Morel et al. on Feb. 18, 1964, discloses a radiator cap attachment with cylindrical indentations along its top portion for providing the user with enhanced frictional gripping of the radiator cap, thus assisting the removal of the cap from a radiator.

U.S. Pat. No. 3,186,263 issued to Walter F. Grote on Jun. 1, 1965, discloses a tool for removing a cap from an automotive radiator with pockets for receiving the ears of a radiator cap. The cap can be removed from a radiator without the user touching the cap.

U.S. Pat. No. 4,697,480 issued to Terry Robideau on Oct. 6, 1987 discloses yet another radiator cap removal tool. This particular invention incorporates a long assembly within an outer sheath. The inner assembly is used to remove the cap. The outer assembly functions as a sheath to prevent steam from injuring an individual.

None of the above prior art, taken either singly or in combination, is seen to describe the instant invention as claimed. The unique inwardly directed securement tabs and the flexibly compliant deflector flange of this invention are not shown in the prior art.

SUMMARY OF THE INVENTION

The radiator cap cover of this invention is held over an existing conventional radiator cap by resilient tabs which extend inwardly from the interior walls of the cover and clasp tightly beneath the radiator cap. The tabs flex to facilitate slipping and locking of the cover over a radiator cap. An additional purpose provided by the tabs is to assist in the unscrewing of the radiator cap. The resilient body, to which the tabs are connected, permits the cover to be easily slipped over the radiator cap. A ring shaped deflector flange protrudes outwardly from the walls of the cover to deflect escaping hot fluid downward upon the removal of the radiator cap. The outer surface of the cover is formed with grooves and ripples to aid in gripping and unscrewing the radiator cap for refilling radiator coolant.

The present invention is a considerable improvement over the prior art. It is a unitary device that may be left attached to a radiator cap to reduce the possibility of personal injury from an overheated radiator. It serves as a tool to aid in the removal of an automotive radiator cap. The cover can remain attached to the radiator cap for the lifetime of the car. Also, the cover is removable so as to be installed on another automobile if desired.

The cover includes a deflector flange for deflecting hot fluids which may be discharged from a radiator when the radiator cap is removed. Fastening of the cover to the radiator cap is achieved by resilient tabs extending from the interior wall of the radiator cap cover.

Accordingly, it is a principal object of the invention to provide an easy-to-use, slip-fit radiator cap cover that effectively deflects hot radiator fluid should it unexpectedly spew from an automotive type radiator.

It is another object of the invention to provide a radiator cap cover that is made from a resilient, heat-resistant material having a low coefficient of thermal conductivity.

It is a further object of the invention to provide a radiator cap cover which grips the radiator cap tightly enough not to be loosened by vibration of a running car.

It is yet another object of the invention to provide a radiator cap cover with a resilient deflector flange for accommodating a conventional radiator overflow hose when the radiator cap and cover are in the installed position.

Still another object of the invention is to provide a tight fitting cover for existing radiator caps which allows easy removal of the radiator caps with the cover in place.

It is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 1 is a top view of a first embodiment of the radiator cap cover placed atop a conventional radiator cap.

FIG. 2 is a cross sectional view taken along the line 2—2 of FIG. 1.

FIG. 3 is a perspective view of a modified embodiment of a radiator cap cover placed atop a conventional radiator having an overflow hose attachment near the radiator cap.

Similar reference characters denote corresponding features consistently throughout the attached drawings.

DETAILED DESCRIPTION OF THE PREFERRED EMBODIMENTS

Figure 4:
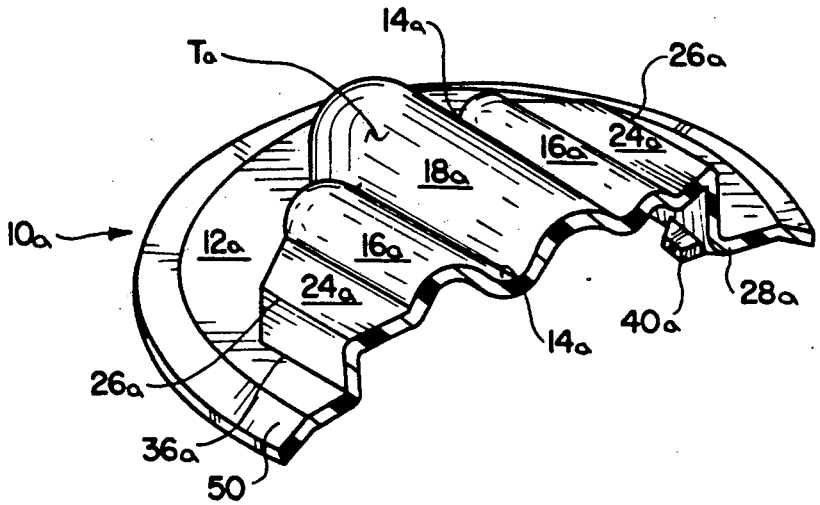
FIG. 4 is a cross sectional perspective view drawn along the line 4—4 of FIG. 3.

The preferred embodiment of the present invention as shown in FIGS. 1 and 2 is a radiator cap cover 10 with a crown C atop a circular base 12. A top surface T of crown C consists of irregular surfaces, with the juxtaposition of smooth, continuous valleys 14 and ridges 16, which act as grip members to provide a firm handhold to prevent slipping of the hand in grasping the device. On the extremities of the top of the middle ridge 18, the most prominent of ridges 16, 18, radiator ear covers 20 fit over the radiator cap ears 22. Because the ear covers 20 are of the same shape as the radiator cap ears 22, the covers 20 and ears 22 are coupled providing the transmittal of rotary force. On the outer perimeter of top surface T of crown C, trapezoidal raised portions 24 provide areas for pressing engagement of an individual's thumbs. Rounded edges 26, instead of sharp edges, outline the trapezoidal raised portions 24 to safeguard against inflicting nicks and scratches to an individual. Interior wall 28 of crown C, along with the interior surface of top T, forms a cavity 30 rendering adequate space for the flush encasing of a radiator cap 32. At the rim 34 of crown C, a round fillet 36 exists to provide a smooth transition from crown C to circular base 12.

Encircling all around and extending from circular base 12, is a resilient flange 38 which points angles downward toward the radiator (not shown). The flange 38 is responsible for the redirection of steam or hot coolant impinging on its interior surface.

As shown most clearly in FIG. 2, the downward sloping angular positioning of flange 38 with respect to circular base 12, relative to the plane of base 12, provides an optimal angle for redirection of steam to prevent the deflection of steam off the surface of the radiator. The deflection effect is undesirable as it may scald and injure an individual standing nearby.

Protruding inward from interior wall 28 of crown C are resilient tabs 40 which serve the purpose of securing radiator cap cover 10 to radiator cap 32. Resilient tabs 40, flexing with the resilient body 42 of cover 10, secure to provide engagement with sidewalls 44 and undersurface 46 of radiator cap 32.

To utilize the present invention, an individual presses downward upon the left/right trapezoidal raised portions 24 with left/right thumbs, respectively. It is worth noting that the thumbs should be pointed in the longitudinal direction along the lengths of the trapezoidal raised portions 24. Simultaneously, the fingers pull up on the flange 38. With the pressing and pulling action of the thumbs and fingers, outer wall 54 of the radiator cover 10 flexes and flares outward to expand rim 34. The expanded rim 34 allows the cover 10 to be continuously slid down the sidewalls 44 of radiator cap 32 until the resilient tabs 40 are able to lockably engage the cap's undersurface 46. In this manner, the radiator cap cover 10 cannot be removed inadvertently. Moreover, steam discharging from the radiator (not shown) will not dislodge the radiator cap cover 10 while the car is operating.

Unscrewing of radiator cap 20 while the radiator cap cover 10 is engaged can be simply performed by turning the cap cover 10, and hence, the encased cap 32 is also turned by the rotary force transmitted to it. With the availability of the peripheral flange 38, the turning action can be performed safely without the threat to an individual from hot coolant spray.

In the modified embodiment as shown in FIGS. 3 and 4, a differently constructed flange 50 allows for the passage of a radiator overflow hose 48. In this embodiment, a flexible flange 50 is formed of a pliable material being much more flexible than the rest of the body. To accommodate passage of the hose 48, flange 50 behaves by flexing in the vicinity of the hose 48 as at area 52 and retains its shape at locations away from the hose 48. The pliable nature of flange 50 allows it to flexibly pass over the radiator hose 48 as cap 32 and radiator cap cover 10*a* are turned for the removal or installation of radiator cap 32 upon a radiator. Areas where the flange 50 retains its original shape provide an individual with protection from hot coolant spray.

The body 42 of the radiator cap over 10 or 10*a* should be composed of a synthetic resinous material to facilitate installation. However, any material which may be suitable for this application is acceptable. Moreover, the material should be able to resist the high temperatures associated with the cooling system of the vehicle. Such a material will not melt nor wear rapidly. Therefore, a cover 10 or 10*a* comprised of such a material will provide a lasting safety feature to any vehicle. The cover 10 or 10*a* should also be composed of a material that will not become hot to the touch even though the cap 32 itself is very hot. The radiator cap with cover locked into position is depicted to facilitate the understanding of the attachment and application of the present invention.

It is to be understood that the present invention is not limited to the sole embodiment described above, but encompasses any and all embodiments within the scope of the following claims.

I claim:

1. A radiator cap cover formed of a resilient material and installable upon a cap for a radiator, said radiator cap cover comprising:

a crowned upper portion including a top surface and a depending rim;

said crowned upper portion including an interior cavity formed so as to closely cooperate with said cap installed therein;

said depending rim including a plurality of resilient tabs extending inwardly therefrom to engage a lower edge of said cap;

said crowned upper portion formed atop a circular base;

said circular base having a flange extending downwardly and outwardly therefrom; whereby said radiator cap cover being cooperatingly installed upon said cap by means of said crowned upper portion interior cavity and said plurality of resilient tabs and said downwardly and outwardly extending flange providing for the deflection of heated fluid issuing from said radiator when said cap and cooperating radiator cap cover are removed from said radiator.

2. The radiator cap cover of claim 1 including:

a plurality of alternating and parallel ridges and valleys formed in said top surface of said upper portion;

said ridges and valleys providing gripping means for a user of said radiator cap cover.

3. The radiator cap cover of claim 1 wherein said radiator cap cover is formed of a heat resistant material.

4. A radiator cap cover formed of a resilient material and installable upon a cap for a radiator of the type including an overflow hose, said radiator cap cover comprising:

a crowned upper portion including a top surface and a depending rim;

said crowned upper portion including an interior cavity formed so as to closely cooperate with said cap installed therein;

said depending rim including a plurality of resilient tabs extending inwardly therefrom to engage a lower edge of said cap;

said crowned upper portion formed atop a circular base;

said circular base having a flange extending downwardly and outwardly therefrom; and said downwardly and outwardly extending flange formed of a flexible and temporarily deformable material to provide accommodation for said overflow hose from said radiator, whereby said radiator cap cover being cooperatingly installed upon said cap by means of said crowned upper portion interior cavity and said plurality of resilient tabs and said downwardly and outwardly extending flange providing for the deflection of heated fluid issuing from said radiator when said cap and cooperating radiator cap cover are removed from said radiator.

5. The radiator cap cover of claim 4 including:

a plurality of alternating and parallel ridges and valleys formed in said top surface of said upper portion;

said ridges and valleys providing gripping means for a user of said radiator cap cover.

6. The radiator cap cover of claim 4 wherein said radiator cap cover is formed of a heat resistant material.

* * * * *